US009658015B2

(12) United States Patent
Alicea, Jr.

(10) Patent No.: US 9,658,015 B2
(45) Date of Patent: May 23, 2017

(54) TRIGGER BLOCKING SYSTEM FOR A FIREARM

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 0 days.

(21) Appl. No.: 14/860,871

(22) Filed: Sep. 22, 2015

(65) Prior Publication Data

US 2016/0084599 A1 Mar. 24, 2016

Related U.S. Application Data

(60) Provisional application No. 62/053,453, filed on Sep. 22, 2014.

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/06; F41A 17/02; F41A 17/04
USPC ..... 42/70.06, 70.11, 84
See application file for complete search history.

(56) References Cited

U.S. PATENT DOCUMENTS 2,978,826 A * 4/1961 Ivy ..... F41A 17/22 42/70.06
4,136,475 A * 1/1979 Centille ..... F41A 17/02 42/70.11
4,384,420 A * 5/1983 Von Muller ..... F41A 17/44 42/70.11
5,022,175 A * 6/1991 Oncke ..... F41A 17/04 42/66
5,433,028 A * 7/1995 Novak ..... F41A 17/06 42/70.06
5,560,134 A * 10/1996 Van Niekerk ..... F41A 17/46 42/70.06
6,032,396 A 3/2000 Shapiro
6,301,816 B1 10/2001 Saltz
6,405,468 B1 * 6/2002 Gilgenbach ..... F41A 17/46 42/70.01
6,510,639 B2 1/2003 McMoore
6,550,175 B2 4/2003 Parker
6,823,621 B2 * 11/2004 Gotfried ..... F41A 17/066 42/70.01
7,051,468 B2 5/2006 Glock
7,360,332 B2 * 4/2008 Rozovsky ..... F41A 17/06 42/106
2002/0029507 A1 3/2002 Saltz
(Continued)

FOREIGN PATENT DOCUMENTS

EP 0592103 4/1994

*Primary Examiner* — Joshua Freeman
(74) *Attorney, Agent, or Firm* — Taft Stettinius & Hollister LLP

(57) ABSTRACT

There is disclosed herein systems, methods and apparatus relating to a trigger block for mechanically blocking the trigger of a firearm and preventing the trigger from being pulled to actuate the firing mechanism when the trigger block is in a blocking position. The trigger block is secured in the blocking position and can only be moved to an unblocked position by an authorized user via operation of a security device, such as a key, sensor, and/or keypad.

19 Claims, 15 Drawing Sheets

(56) References Cited

U.S. PATENT DOCUMENTS

2014/0305017 A1* 10/2014 Travis ..... F41A 17/063
42/70.06

* cited by examiner

TRIGGER BLOCKING SYSTEM FOR A FIREARM

The present application claims the benefit of the filing date of U.S. Provisional Application Ser. No. 62/053,453 filed on Sep. 22, 2014, which is incorporated herein by reference in its entirety.

BACKGROUND

Firearms typically rely on mechanical systems to control the firing of projectiles from the firearm. For example, a trigger is typically used to actuate the firing mechanism to fire a projectile. In order to limit the use of firearms to authorized persons, trigger locks have been developed that mount on the trigger guard and prevent access to the trigger unless the trigger lock is removed. While such devices are steps in the right direction, they can be bulky and difficult to install and remove, and are not part of the firearm. Therefore, the owner may forget or be reluctant to install the trigger lock, and such devices can be misplaced or lost. Thus, further improvements in this technology area are needed.

SUMMARY

There is disclosed herein systems, methods and apparatus relating to preventing unauthorized operation of a firearm with a trigger that is pulled to actuate a firing mechanism to fire projectiles from the firearm. In one embodiment, the systems, methods and apparatus include a trigger block that is integrated with the firearm and configured to mechanically block the trigger and prevent the trigger from being pulled to actuate the firing mechanism when the trigger block is in a blocking position. In another embodiment, the systems, methods and apparatus include a trigger block that when in the blocking position remains engaged to the trigger whether the hammer is cocked or uncocked. In either embodiment, the trigger block is secured in the blocking position and can only be moved to an unblocked position by an authorized user via operation of a security device, such as a key, sensor, and/or keypad. In certain embodiments, the trigger block is supported along a removable portion of a trigger guard and is moveable in a reciprocating manner along a length of the trigger guard between the blocking position and the unblocked position.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION THE ILLUSTRATED EMBODIMENTS

Figure 1:
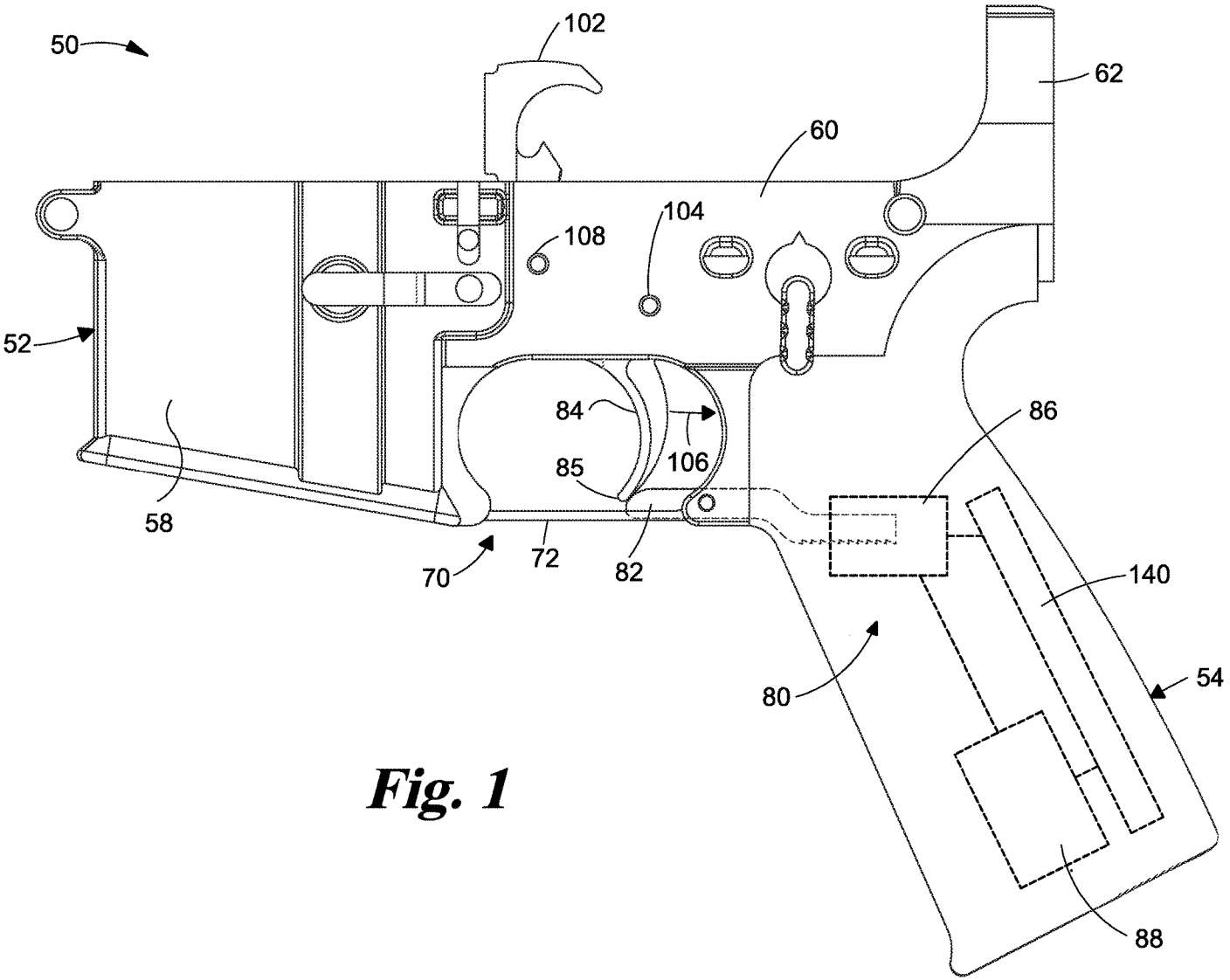
FIG. 1 is an elevation view of a lower receiver/grip assembly of a firearm with a trigger blocking system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, there is shown a firearm 50 that includes a lower receiver 52 and a grip assembly 54 secured to lower receiver 52. It should be understood that not all details of firearm 50 are shown, such as its upper receiver, bolt assembly and barrel, it being understood that the present disclosure has application to any suitable upper receiver and barrel for a firearm. In one embodiment, firearm 50 is an AR-15 or M16 type firearm, although other firearm types are also contemplated, such as an AK-47 or suitable assault type rifle with a trigger guard having or modifiable to have a trigger guard 70 with a removable guard portion 72 along the lower or bottom side of trigger 84. As discussed further below, firearm 50 includes a trigger blocking system 80 with a trigger blocking device 82 that is structured to selectively engage with trigger 84 in a blocking position to block movement of trigger 84 and to disengage from trigger 84 in an unblocked position to allow normal operation of firearm 50.

Figure 4:
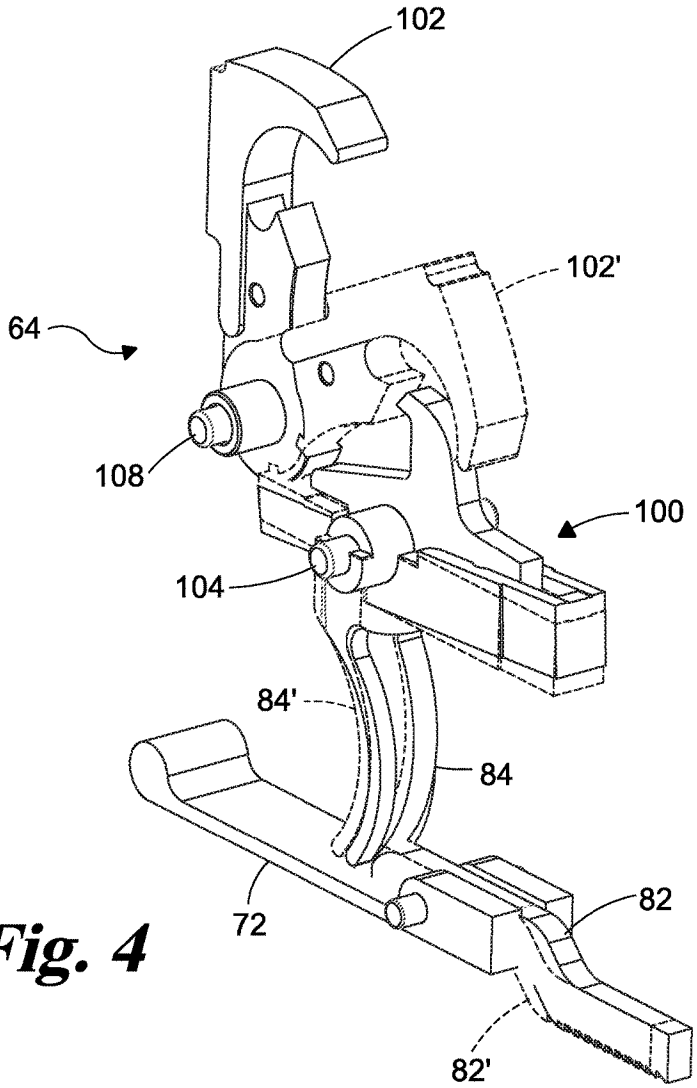
FIG. 4 is a perspective view of the trigger block and a firing mechanism of the firearm showing the trigger block engaged to the trigger when the hammer is cocked and uncocked.

Lower receiver 52 of firearm 50 includes a magazine holder 58 for receiving a magazine (not shown) and a housing 60 with a buffer tube or stock assembly attachment member 62 at a rearward end thereof. Housing 60 defines a compartment (not shown) for housing a firing mechanism 64 that includes a sear assembly 100 (FIG. 4) and a hammer 102 that is movable between an uncocked position as indicated by hammer 102 and a cocked position as indicated by hammer 102' (FIGS. 2 and 4) about a hammer pin 108, which also couples hammer 102 to lower receiver 52. Trigger 84 is coupled to sear assembly 100 with a pin arrangement 104, which also couples sear assembly 100 to lower receiver 52. Hammer 102 is movable between the cocked position as shown by hammer 102' to a released or uncocked position as shown by hammer 102 by pulling of trigger 84 in a rearward direction 106.

Figure 2:
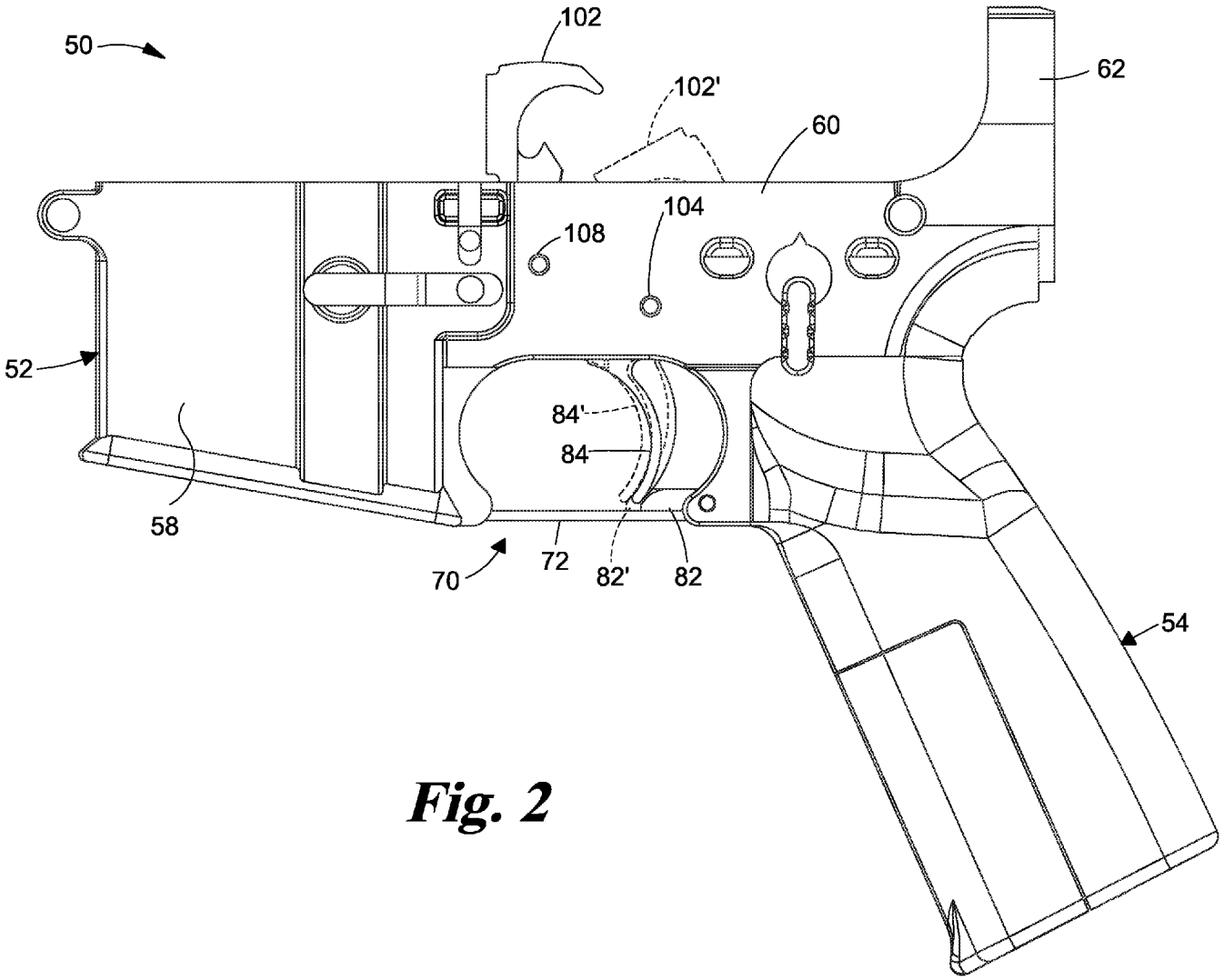
FIG. 2 is another elevation view of the lower receiver/grip assembly of FIG. 1 showing a trigger block of the trigger blocking system engaged to the trigger when the hammer is cocked and uncocked.
Figure 3:
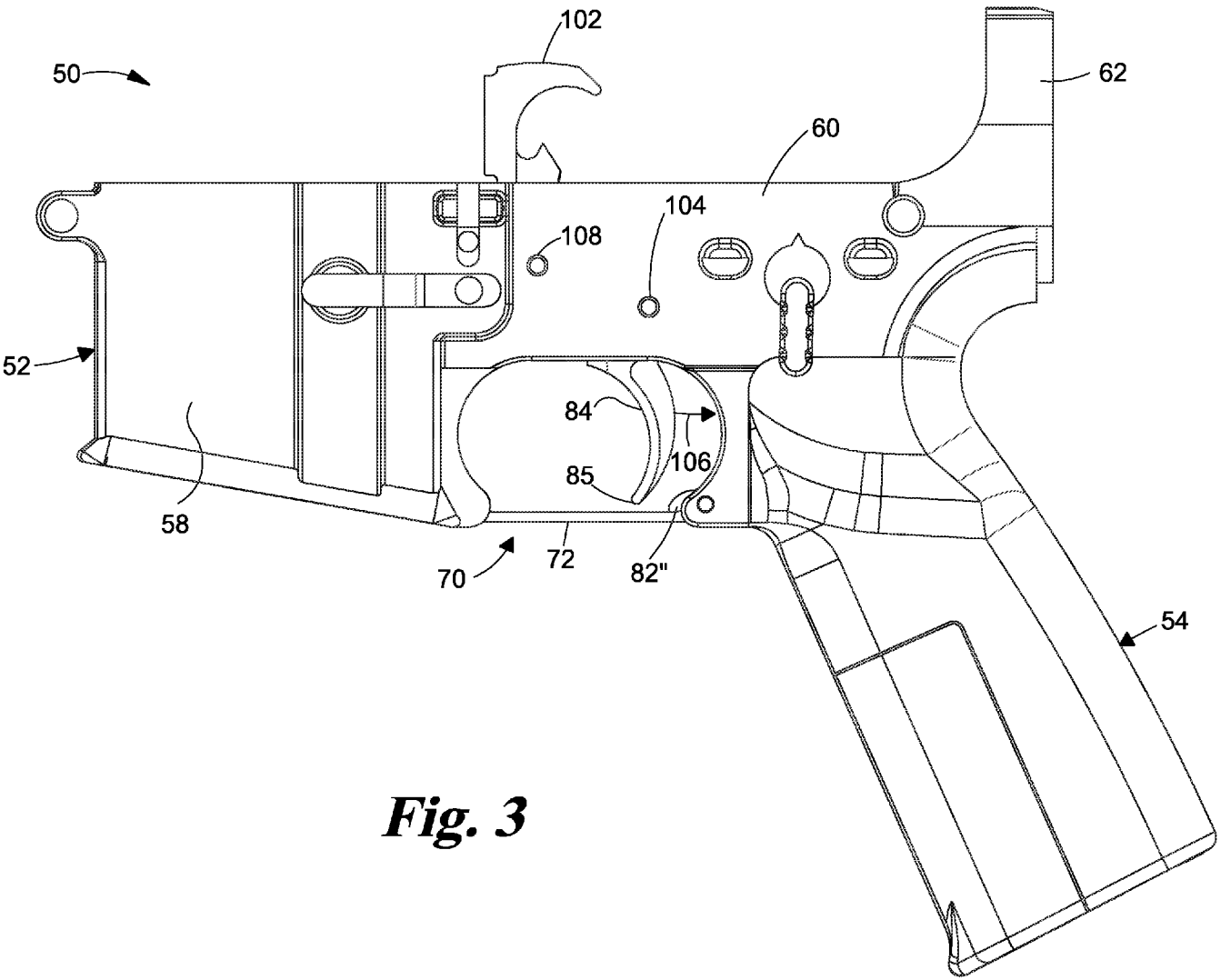
FIG. 3 is another elevation view of the lower receiver/grip assembly of FIG. 1 showing the trigger block disengaged from the trigger.
Figure 5:
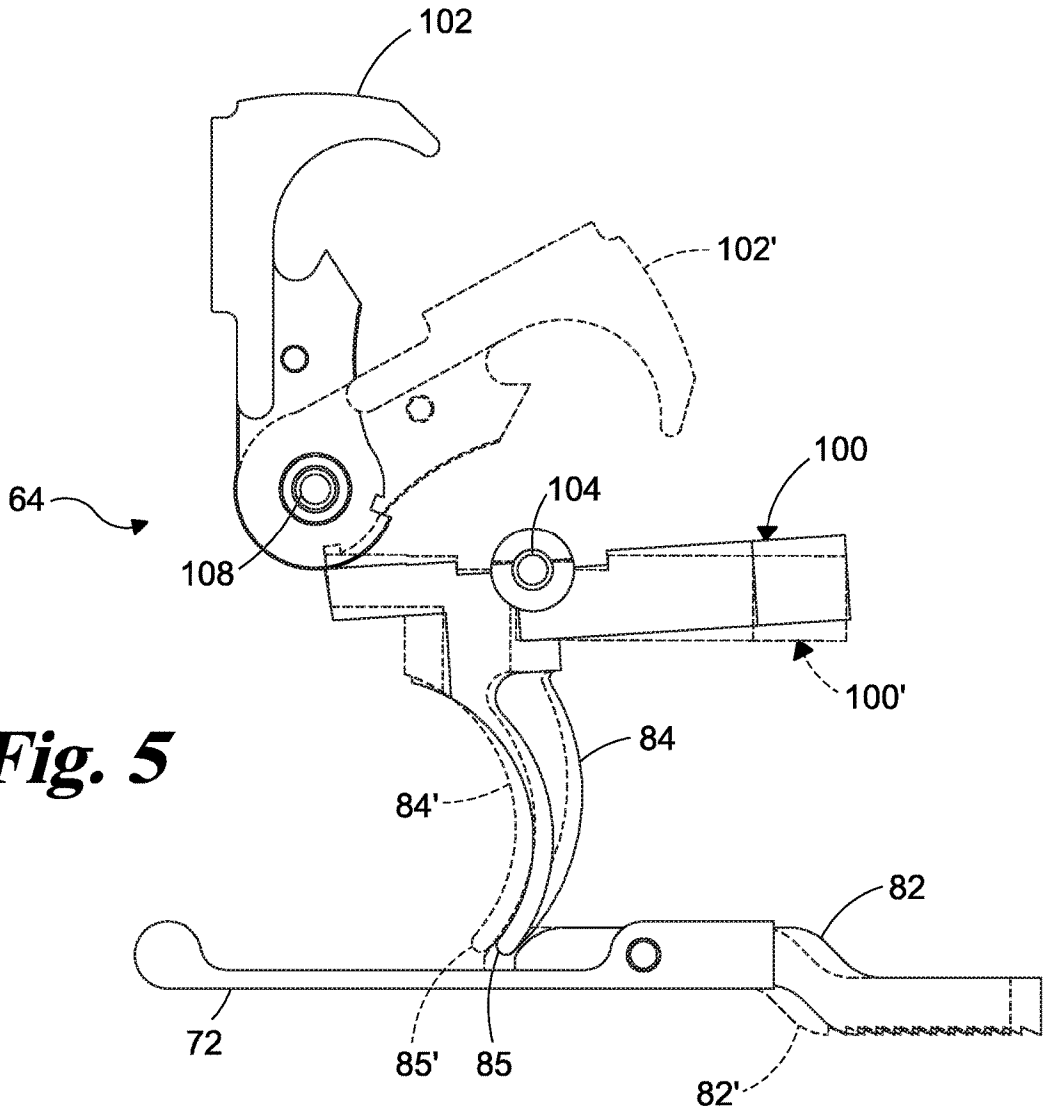
FIG. 5 is an elevation view of the trigger block and firing mechanism of FIG. 4 showing the trigger block engaged to the trigger when the hammer is cocked and uncocked.
Figure 6:
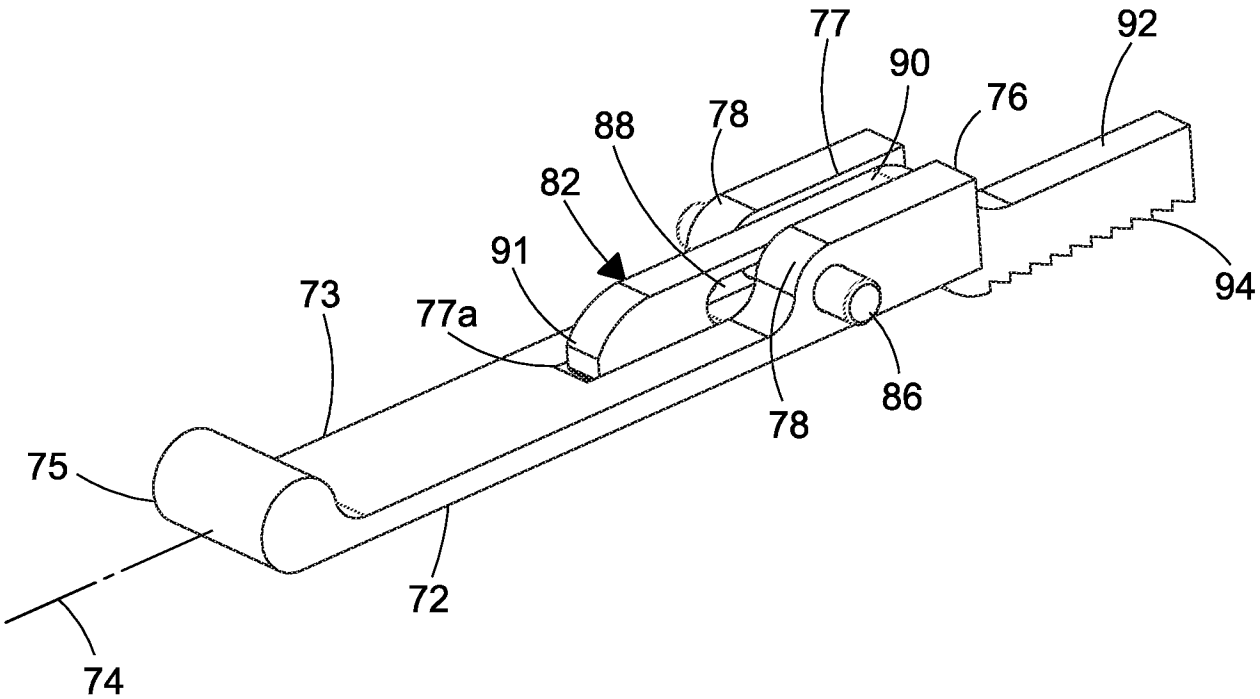
FIG. 6 is a perspective view of the trigger block and a removable portion of the trigger guard of the firearm with the trigger block in a blocking position.
Figure 7:
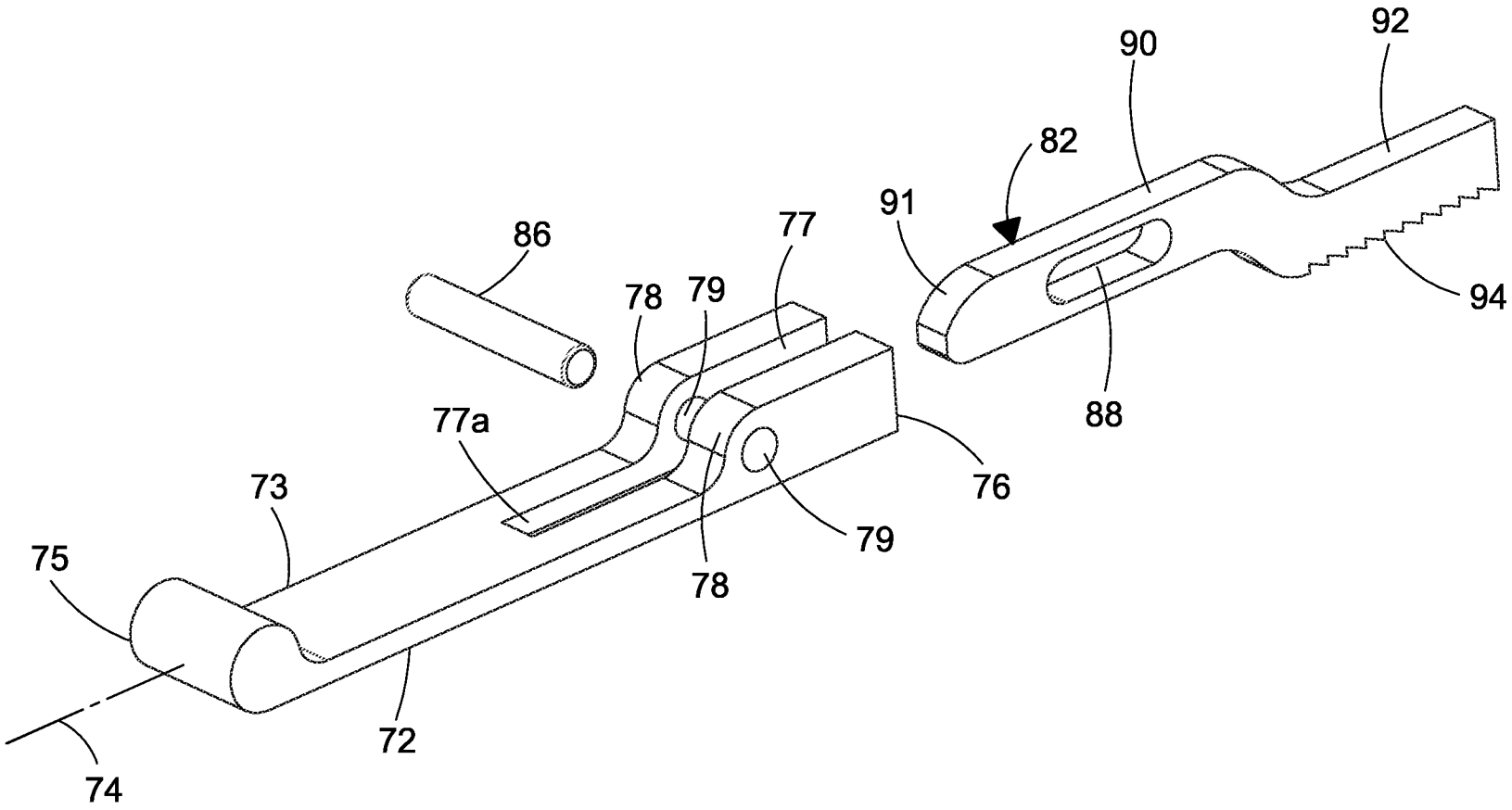
FIG. 7 is an exploded perspective view of the trigger block and the removable portion of the trigger guard of the firearm.
Figure 8:
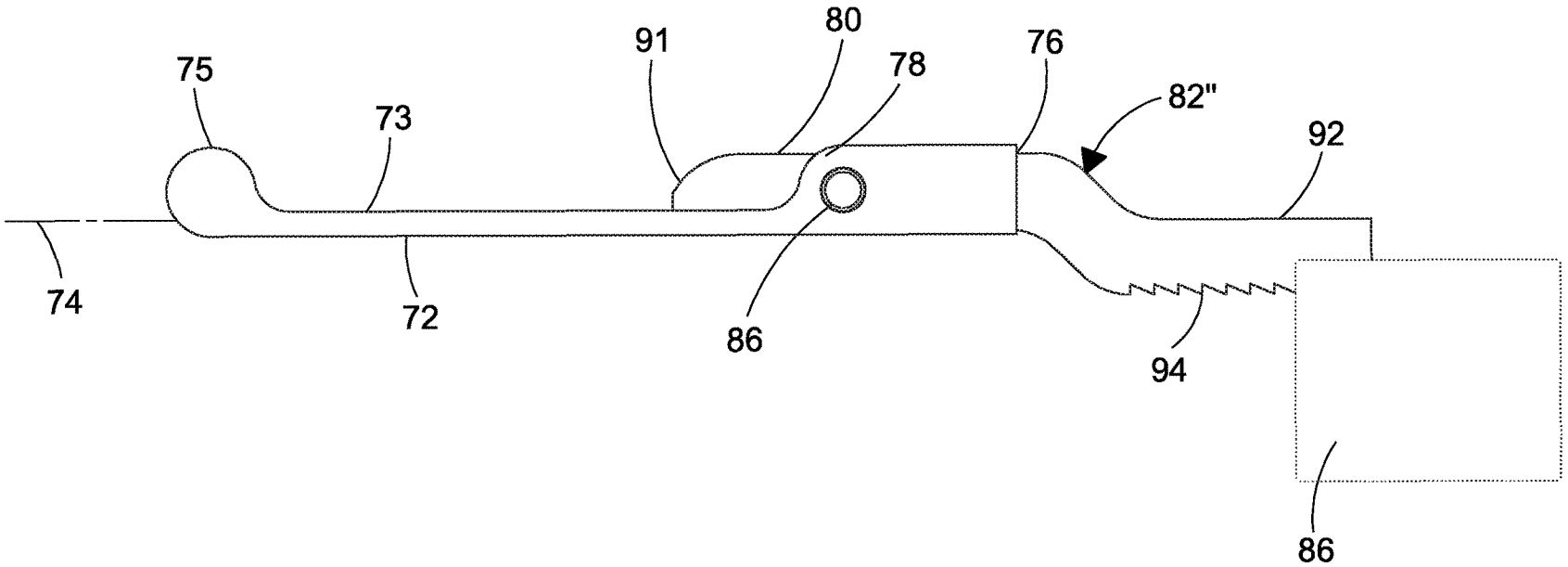
FIG. 8 is an elevation view of the trigger block and the removable portion of the trigger guard with an actuating device for reciprocating the trigger block with the trigger block in an unblocked position.
Figure 9:
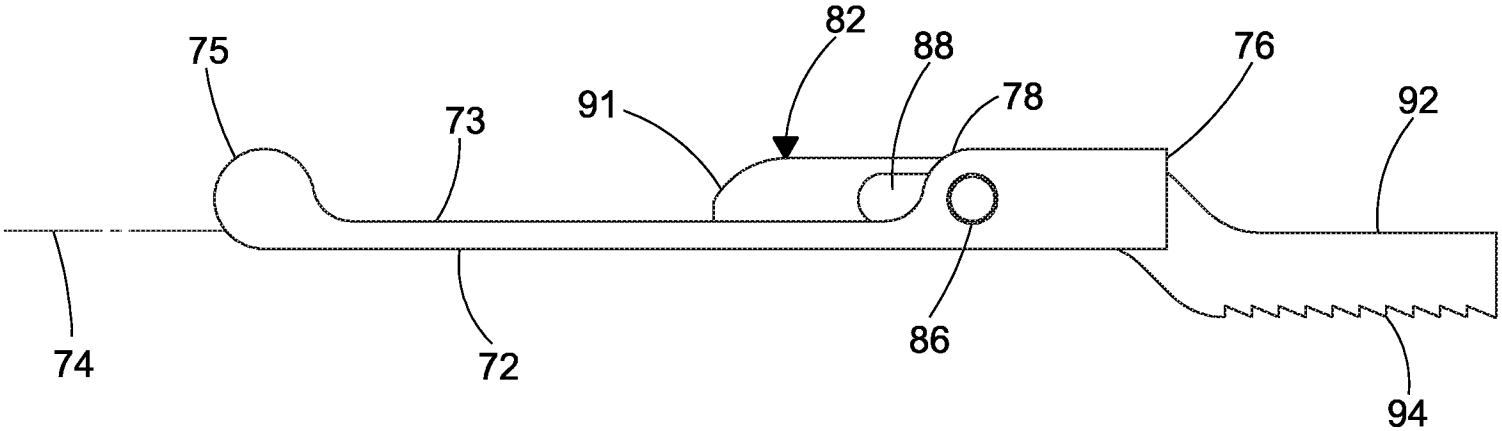
FIG. 9 is an elevation view of the trigger block and the removable portion of the trigger guard with the trigger block in a blocking position.

Trigger blocking system 80 includes trigger blocking device 82 associated with trigger guard 70, an actuating device 86 in grip 54 connected to trigger blocking device 82, a security device 88 in or accessible through grip 54 that is connected to actuating device 86, and, in certain embodiments, an electronic control device 140 in grip 54 that is connected to actuating device 86 and security device 88. As shown in FIGS. 1 and 2, trigger blocking device 82 extends into trigger guard 70 and contacts a lower or bottom end 85 of trigger 84 to prevent movement of trigger 84 in the rearward direction 106, thus effectively locking and disabling firearm 50. As further shown in FIGS. 2, 4 and 5, when hammer 102 is in the cocked position as indicated by hammer 102', trigger 84 pivots forwardly as indicated by forwardly displaced trigger 84' and sear assembly 100 also pivots as indicated by sear assembly 100'. Trigger blocking device 82 is biased forwardly to maintain contact with forwardly displaced trigger 84' with cocked hammer 102', as indicated by forwardly displaced trigger blocking device 82' in engagement with trigger 84'. As shown in FIG. 3, when trigger blocking device 82 is disengaged and moved to an unblocked position 82", trigger blocking device is spaced from trigger 84 and trigger 84 may be pulled in a rearward direction 106 to fire firearm 50.

One embodiment trigger blocking device 82 and removable guard portion 72 are shown in FIGS. 6-9. Removable guard portion 72 includes an elongated body 73 extending along a longitudinal axis 74 between a first end 75 and an opposite second end 76. Body 73 includes a notch 77 extending forwardly along longitudinal axis 74 from second end 76 that receives trigger blocking device 82 in a sliding, reciprocating arrangement. Body 73 also includes ears 78 that define holes 79 to receive a pin 86 therein with pin 86 extending through a slot 88 of trigger blocking device 82. Notch 77 extends along a portion of the length of body 73 and forms a groove **77*a* in body 73 that, along with pin 86, slidably captures trigger blocking device 82 on guard portion 72. Groove 77*a* does not extend completely through body 73, although embodiments in which groove 77*a* extends through body 73** are also envisioned.

Trigger blocking device 82 includes a blocking portion 90 and an extension portion 92 extending rearwardly from blocking portion 90. Blocking portion 90 includes a rounded leading end nose 91 that contacts trigger 84 when in the blocking position. Extension portion 92 may be offset longitudinally from blocking portion 90, although co-longitudinal, transverse, and other arrangements are also contemplated. Extension portion 92 may include teeth 94 or other suitable connecting arrangement to engage an actuating device 86 to allow reciprocating movement of blocking device 82 and the maintenance of blocking device 82 in the blocking position or the unblocked position. In one embodiment, teeth 94 are ratcheted to maintain trigger blocking device 82 in a forwardly displaced position in positive engagement with trigger 84 until trigger blocking device 82 is released, and trigger blocking device 82 is reciprocated in notch 77 along groove **77*a* of guard portion 72. In one embodiment, an actuating device 86 that is in the form of a gear wheel or pinion is provided to advance trigger blocking device 82 to the blocking position and/or to retract trigger blocking device 82 to the unblocked position. In certain embodiments, a spring (not shown) or other biasing device can be provided to normally bias trigger blocking device 82 into engagement with trigger 84, 84' when trigger blocking device is in the blocking position. In this embodiment, teeth 94 engage the actuating device 86 to maintain the blocking engagement of blocking device 82 with trigger 84 even if trigger 84 pivots forwardly as indicated by trigger 84' in response to hammer 102 being cocked as indicated by hammer 102'. In another embodiment, actuating device 86 includes a reciprocating rod, drive member, worm gear, shaft, piston, other actuator suitable to reciprocate trigger blocking device 82 between the blocking position (FIGS. 6 and 9) and unblocked position (FIG. 8) relative to trigger 84 and guard portion 72**.

Figure 10:
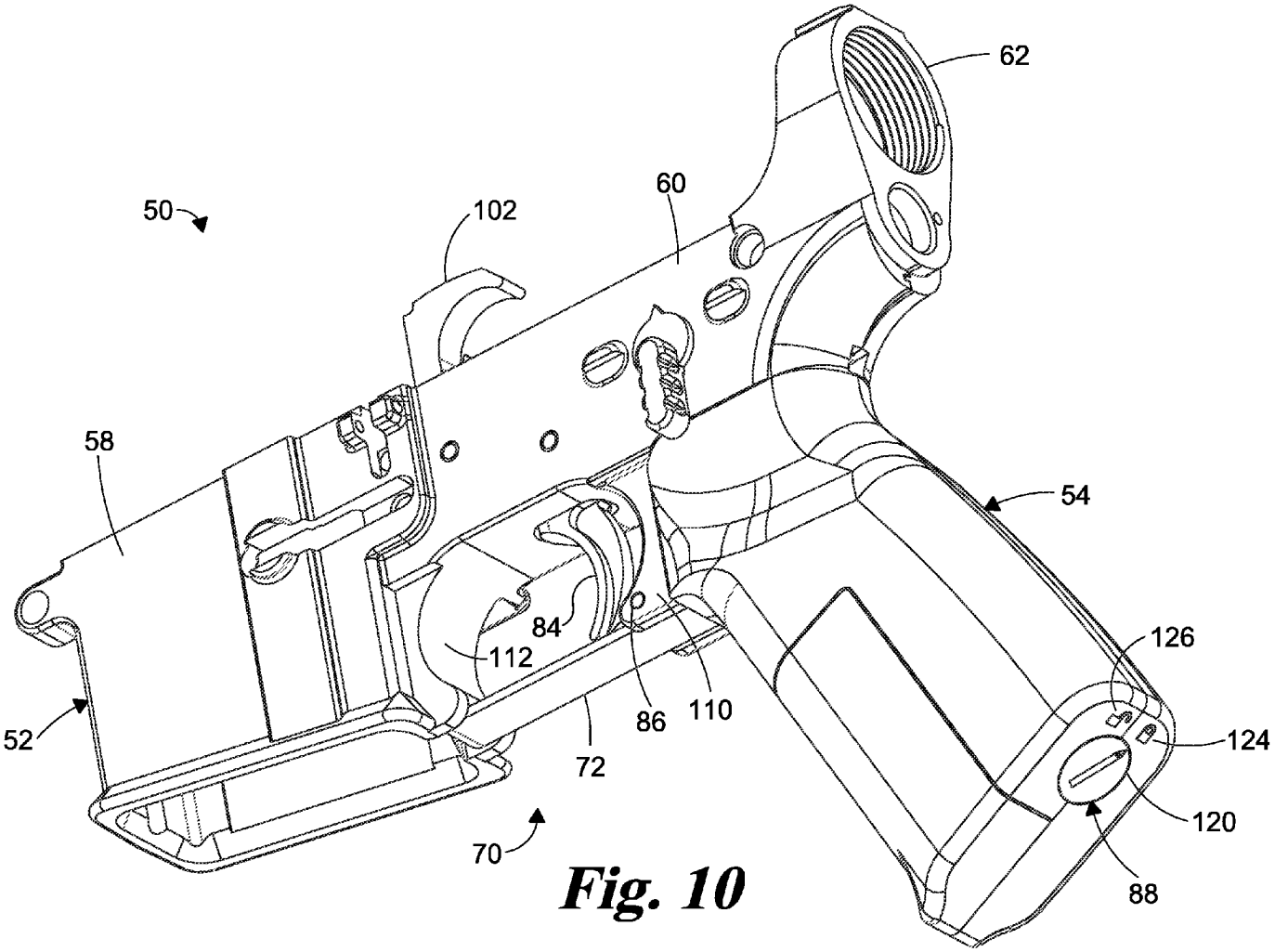
FIG. 10 is a perspective view of the lower receiver/grip assembly of FIG. 1 showing one embodiment of a security device in a locked position for locking the trigger block in the blocking position.

Referring further to FIG. 10, guard portion 72 is shown mounted to lower receiver 52. In particular, pin 86 is mounted to a rearward guard portion 110 at the rearward side of trigger 84, and first end 75 is mounted to forward guard portion 112 at the forward side of trigger 84. Accordingly, a lower receiver 52 with a standard trigger guard may be readily modified to include the firearm trigger blocking system 80 disclosed herein by substituting the inventive guard portion 72 for the existing guard portion and adding trigger blocking device 82.

Figure 11:
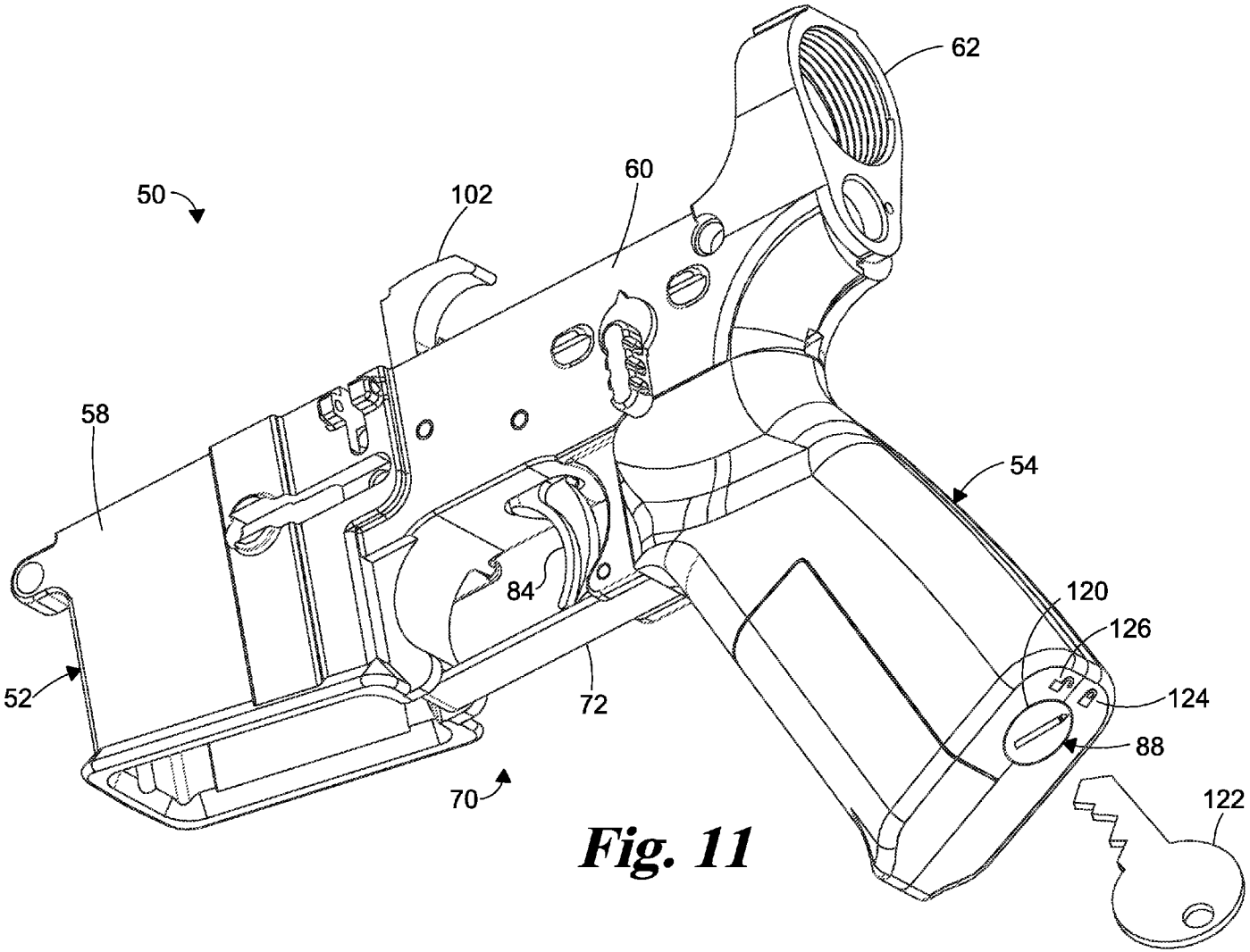
FIG. 11 is a perspective view of the lower receiver/grip assembly of FIG. 10 showing a key for use with the locking mechanism.
Figure 12:
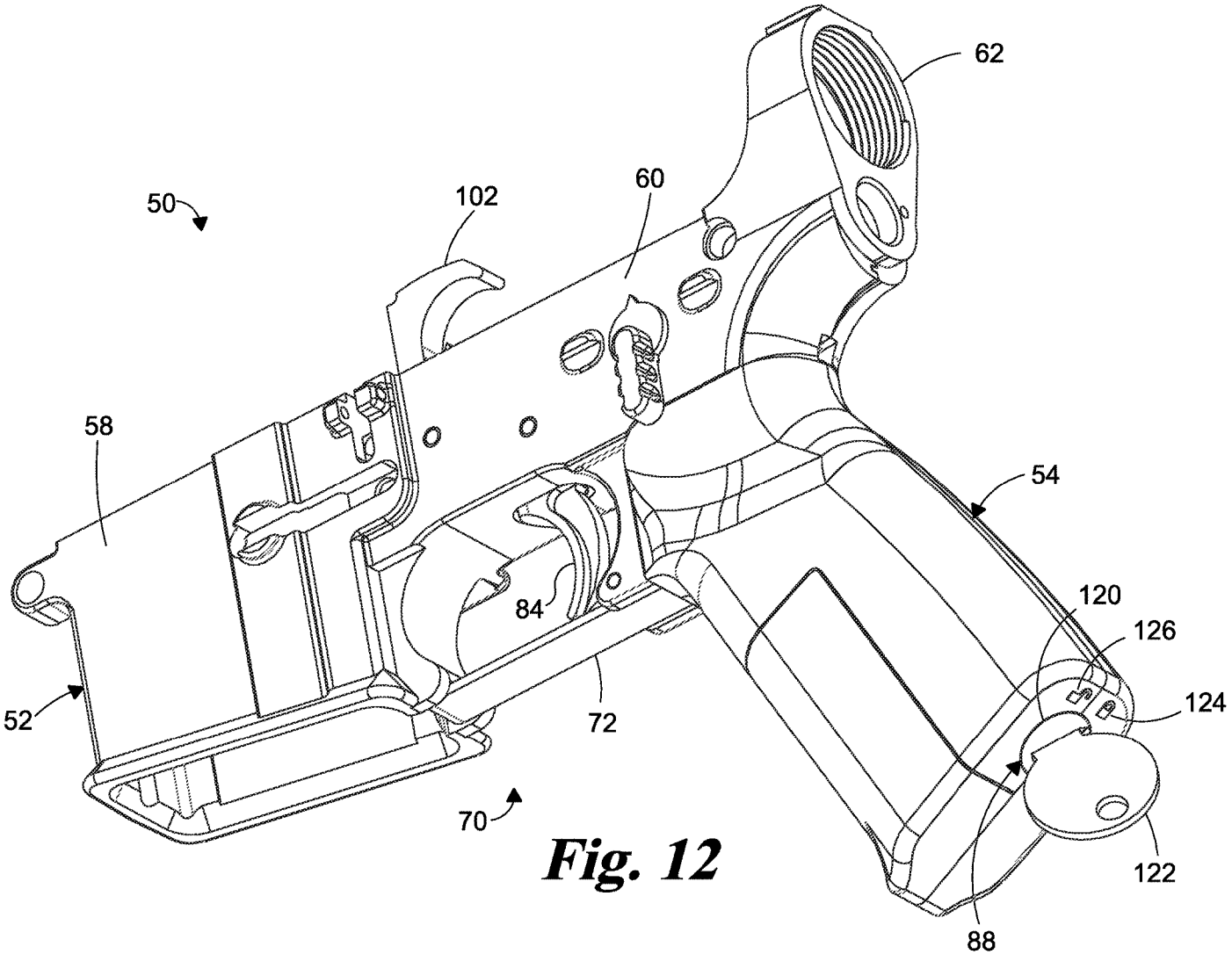
FIG. 12 is a perspective view of the lower receiver/grip assembly of FIG. 10 showing a key inserted into the security device.
Figure 13:
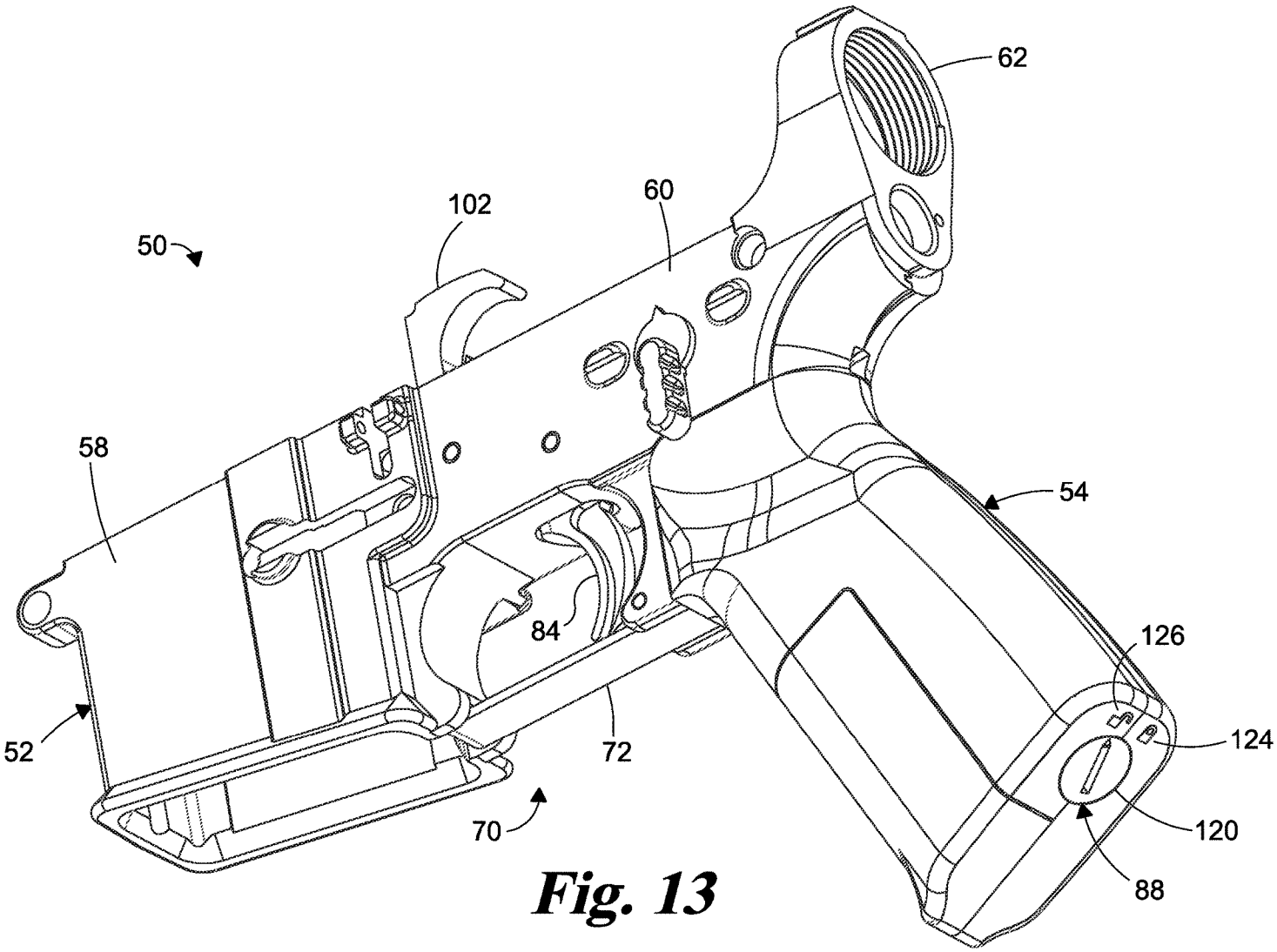
FIG. 13 is a perspective view of the lower receiver/grip assembly of FIG. 10 showing the security device in an unlocked position.

FIG. 10 further shows one embodiment of a security device 88 in the form of a lock cylinder 120 that is movable between a secure or locked position (FIGS. 10-12) and an unsecure or unlocked position (FIG. 13) by insertion of a key into lock cylinder 120 and turning lock cylinder 120 with key 122 to the unlocked position, as shown in FIG. 13. In one embodiment, grip 54 includes indicators 124, 126 to indicate a locked position and the unlocked position, respectively. Indicators 124, 126 can include graphical representations, LED's, lights, audible devices, a display, or other suitable indicator to output locked and unlocked information to the user.

Figure 16:
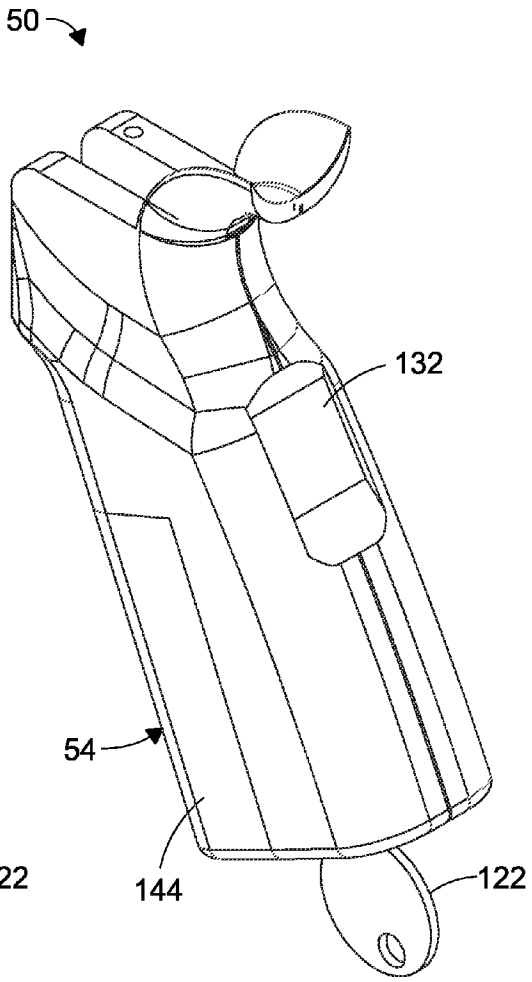
FIG. 16 is a perspective view of the grip assembly showing an embodiment of the security device that utilizes a key and a sensor for unlocking the trigger block.
Figure 15:
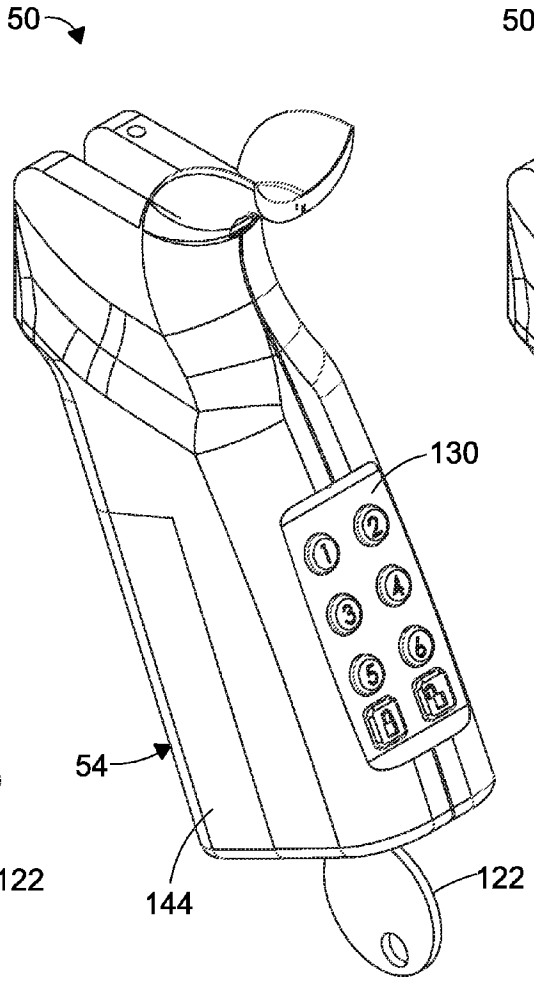
FIG. 15 is a perspective view of the grip assembly showing an embodiment of the security device that utilizes a key and keypad for unlocking the trigger block.
Figure 14:
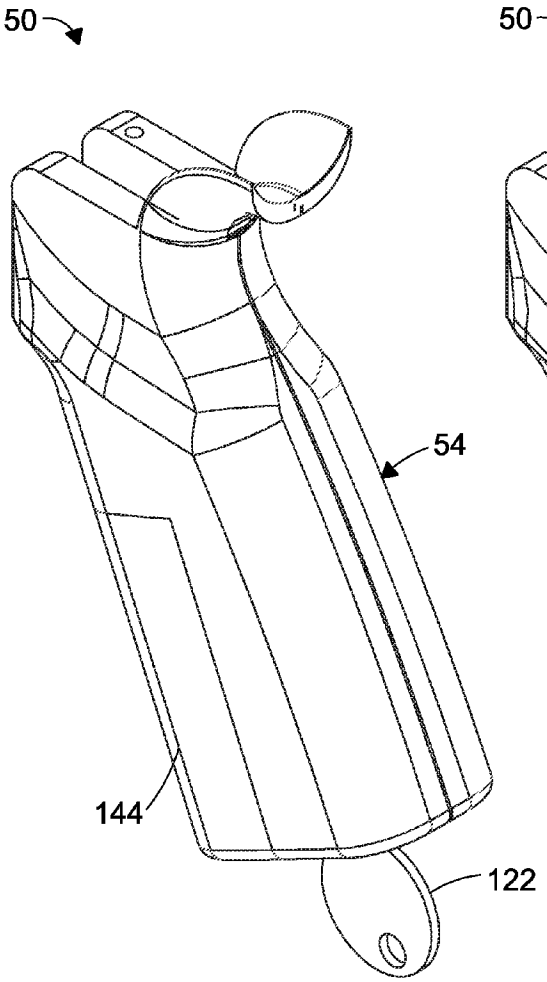
FIG. 14 is a perspective view of the grip assembly showing an embodiment of the security device that utilizes a key for unlocking the trigger block

Referring to FIG. 14, firearm 50 is shown with a grip assembly 54 including a lock cylinder type security device 88 with a lock cylinder to receive key 122. In the FIG. 14 embodiment, the user simply needs key 122 to manipulate actuating device 86 to move blocking device 82 between the blocking position and the unblocked position. In addition to a lock cylinder operable by a key, security device 88 can include a keypad 130 such as shown in FIG. 15, or a sensor 132 such as shown in FIG. 16. Keypad 130 can be programmed to receive a code or other secure input in order to unlock security device 88 and allow key 122 to be used to operate actuating device 86 to move blocking device 82 between the blocking position and unblocked position. Similarly, sensor 132 can be programmed to receive a finger print, thumb print, eye scan, voice command, or other secure input in order to unlock security device 88 and allow key 122 to be used to operate actuating device 86 to move blocking device 82 between the blocking position and unblocked position. Embodiments are also contemplated in which keypad 130 or sensor 132 are employed as security device 88 without a lock cylinder 120 or key 122.

Referring back to FIG. 1, security device 88 and, if provided, keypad 130 or sensor 132, can be connected to electronic control device 140. Electronic control device 140 can be in the form of a printed circuit board, programmable controller, microprocessor-based control circuit, or other suitable device that prevents actuating device 86 from manipulating trigger blocking device 82 unless the requisite key is inserted and/or input is provided to electronic control device 140 by a keypad or sensor. When the required secure input is provided, actuating device 86 can be energized or enabled, and then actuating device 86 can be operated by a switch that is actuated when key 122 is inserted and moved to the locked or unlocked position to move trigger blocking device to the associated blocking position or unblocked position. In still another embodiment, actuating device 86 is entirely mechanical and is operated to displace trigger blocking device 82 by rotation of lock cylinder 120 with key 122.

Figure 17:
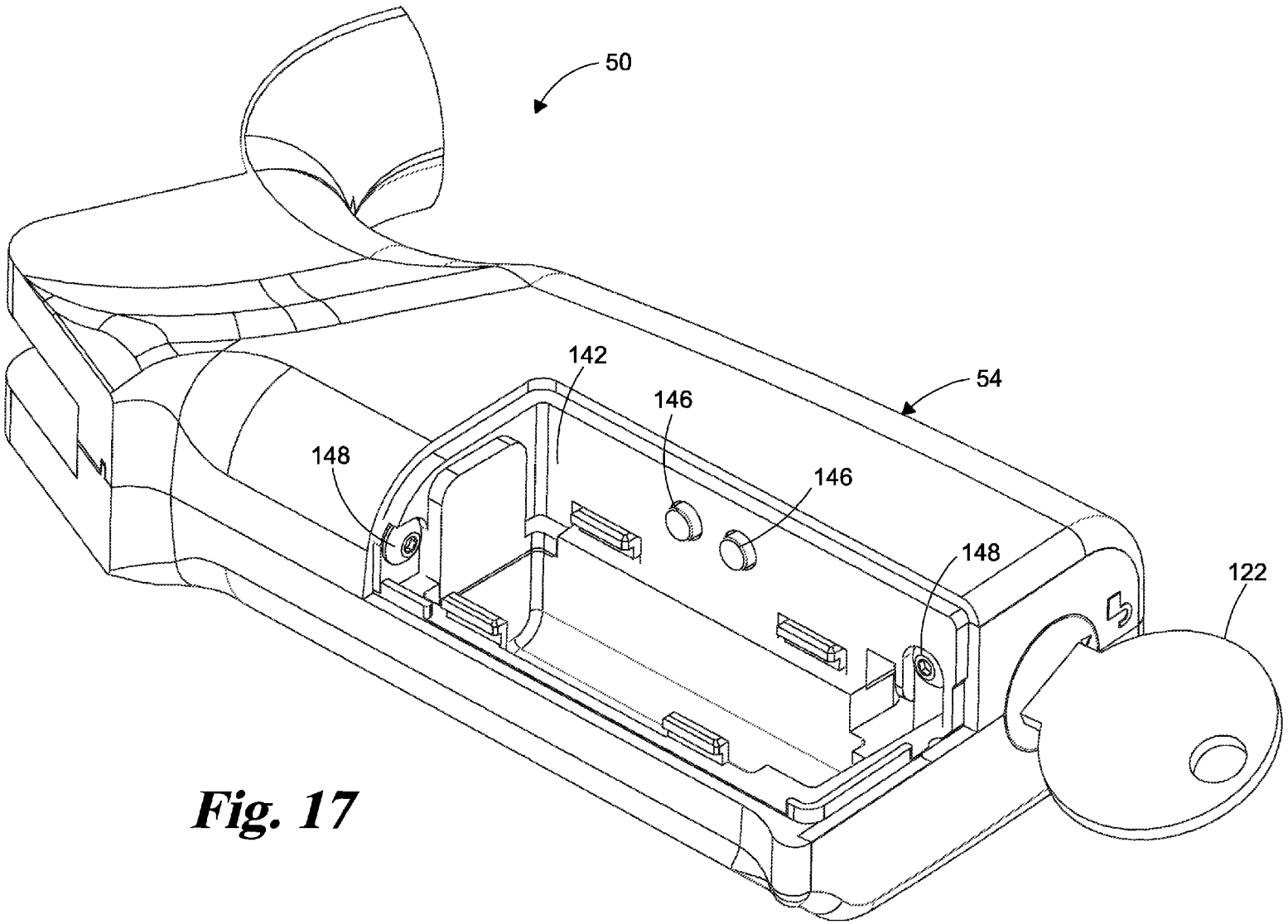
FIG. 17 is a perspective view of the grip assembly showing the security device in an unlocked position and an access cover removed from a compartment of the grip.

Referring to FIG. 17, an embodiment of grip 54 is shown that includes a compartment 142 that is closeable with a removable cover 144 (FIGS. 14-16.) Compartment 142 houses input devices 146, such as buttons or any other suitable input device, that can be used to program electronic control device 140 in order to, for example, change input codes to unlock trigger blocking device 82, change or add authorized users, or other electronic control functions. In one embodiment, fasteners 148 that assemble components of grip 54 and enclose actuating device 86 and securing device 88 are housed in and accessible in compartment 142. Fasteners 148 are only accessible when cover 144 is removed, and cover 144 is arranged with security device 88 so that cover 144 can only be removed if key 122 is inserted to unlock security device 88.

Various aspects of the disclosed trigger blocking system are contemplated. According to one aspect, a trigger blocking device is coupled to a removable guard portion of a trigger guard. The trigger blocking device is movable along the removable guard position between a blocking position for blocking rearward movement of a trigger housed in the trigger guard and an unblocked position allowing rearward movement of the trigger in the trigger guard.

According to another aspect, a firearm includes a lower receiver and a grip assembly that includes a firing mechanism and a trigger guard. The firing mechanism includes a hammer moveable between a cocked and uncocked position, a sear assembly coupled to the hammer, and a trigger coupled to the sear assembly with the trigger positioned in the trigger guard. The trigger guard includes a removable guard portion along a lower side of the trigger. The firearm also includes a trigger blocking device coupled to the removable guard portion of the trigger guard. The trigger blocking device is movable along the removable guard position between a blocking position for blocking rearward movement of the trigger and an unblocked position allowing rearward movement of the trigger in the trigger guard.

Various embodiments and refinements of these aspects of the trigger blocking system are also contemplated. For example, in one embodiment the trigger blocking device includes a blocking portion movable along the removable guard portion and an extension portion extending from the guard portion and into a grip of the firearm. In a refinement of this embodiment, the removable guard portion includes a notch that receives the blocking portion. In a further refinement, the blocking portion includes an elongated slot extending therethrough and the removable guard portion includes a pair of ears on opposite sides of the notch, and a pin extends between the ears through the elongated slot that slidably captures the trigger blocking device in the notch. In yet a further refinement, the extension portion of the trigger blocking device includes a plurality of teeth therealong for engagement with an actuating device. In a further refinement, the trigger blocking device is normally biased forwardly toward the blocking position.

According to another embodiment, an actuating device is engaged to the trigger blocking device, and the actuating device is operable to move the trigger blocking device between the blocking position and the unblocked position. In a refinement of this embodiment, a security device is coupled to the actuating device, and the security device is movable between a locked position in which the trigger blocking device is locked in the blocking position and an unlocked position in which the trigger blocking device is movable from the blocking position to the unblocked position. In a further refinement, an electronic control device is connected to the actuating device and the security device. In another refinement, the security device includes an input device to enable operation of the actuating device. The input device can be a keypad or sensor. In another refinement, the security device includes a lock cylinder that is operable by a key inserted into the lock cylinder to move the security device between the locked and unlocked positions.

In another embodiment, the trigger blocking device is supported on the removable guard portion and contacts a lower end of the trigger in the blocking position. In a refinement of this embodiment, the removable guard portion defines a groove along a portion of a length thereof and the trigger blocking device resides in the groove. In another refinement, the trigger blocking device includes an elongated body with a rounded nose that contacts a rearward side of the lower end of the trigger.

In another embodiment, the trigger blocking device includes a blocking portion movable along the removable guard portion and an extension portion extending from the guard portion and into the grip assembly. In a refinement of this embodiment, the removable guard portion includes a notch that receives the blocking portion of the trigger blocking device, the notch forming a groove along the removable guard portion, and the blocking portion resides in the groove. In a further refinement, the blocking portion of the trigger blocking device includes an elongated slot extending therethrough and the removable guard portion includes a pair of ears on opposite sides of the notch, and a pin extends between the ears through the elongated slot to slidably capture the trigger blocking device in the groove.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a trigger blocking device coupled to a removable guard portion of a trigger guard, wherein the trigger blocking device is movable along the removable guard portion between a blocking position for blocking rearward movement of a trigger housed in the trigger guard and an unblocked position allowing rearward movement of the trigger in the trigger guard, wherein the trigger blocking device includes a blocking portion movable along the removable guard portion and an extension portion extending from the guard portion and into a grip, wherein the removable guard portion receives the blocking portion and the blocking portion defines an elongated slot, and further comprising a pin that extends through the elongated slot to slidably capture the trigger blocking device on the removable guard portion.

2. The apparatus of claim 1, wherein the removable guard portion includes a notch that receives the blocking portion and the removable guard portion includes a pair of ears on opposite sides of the notch, wherein the pin extends between the ears through the elongated slot.

3. The apparatus of claim 2, wherein the extension portion includes a plurality of teeth therealong for engagement with an actuating device.

4. The apparatus of claim 3, wherein the trigger blocking device is normally biased forwardly toward the blocking position.

5. The apparatus of claim 1, further comprising an actuating device engaged to the trigger blocking device, wherein the actuating device is operable to move the trigger blocking device between the blocking position and the unblocked position.

6. The apparatus of claim 5, further comprising a security device coupled to the actuating device, wherein the security device is movable between a locked position in which the trigger blocking device is locked in the blocking position and an unlocked position in which the trigger blocking device is movable from the blocking position to the unblocked position.

7. The apparatus of claim 6, further comprising an electronic control device connected to the actuating device and the security device.

8. The apparatus of claim 7, wherein the security device includes an input device to enable operation of the actuating device.

9. The apparatus of claim 8, wherein the input device is a keypad.

10. The apparatus of claim 8, wherein the input device is a sensor.

11. The apparatus of claim 6, wherein the security device includes a lock cylinder that is operable by a key inserted into the lock cylinder to move the security device between the locked and unlocked positions.

12. The apparatus of claim 1, wherein the trigger blocking device is supported on the removable guard portion and contacts a rearward side of a lower end of the trigger in the blocking position.

13. The apparatus of claim 12, wherein the removable guard portion defines a groove along a portion of a length thereof and the trigger blocking device resides in the groove.

14. The apparatus of claim 12, wherein the trigger blocking device includes an elongated body with a rounded nose that contacts the lower end of the trigger.

15. A firearm, comprising:

a lower receiver and a grip assembly that includes a firing mechanism and a trigger guard, the firing mechanism including a hammer moveable between a cocked and uncocked position, a sear assembly coupled to the hammer, and a trigger coupled to the sear assembly with the trigger positioned in the trigger guard, wherein the trigger guard includes a removable guard portion along a lower side of the trigger; and a trigger blocking device coupled to the removable guard portion of the trigger guard, wherein the trigger blocking device is movable along the removable guard portion between a blocking position for blocking rearward movement of the trigger and an unblocked position allowing rearward movement of the trigger in the trigger guard, wherein the trigger blocking device includes a blocking portion movable along the removable guard portion and an extension portion extending from the guard portion and into the grip assembly, wherein the removable guard portion receives the blocking portion and the blocking portion defines an elongated slot, and further comprising a pin that extends through the elongated slot to slidably capture the trigger blocking device on the removable guard portion.

16. The firearm of claim 15, wherein the removable guard portion includes a notch that receives the blocking portion of the trigger blocking device, the notch forming a groove along the removable guard portion, and the blocking portion resides in the groove.

17. The firearm of claim 16, wherein the removable guard portion includes a pair of ears on opposite sides of the notch, wherein the pin extends between the ears through the elongated slot to slidably capture the trigger blocking device in the groove.

18. An apparatus comprising:

a trigger blocking device coupled to a removable guard portion of a trigger guard, wherein the trigger blocking device is movable along the removable guard portion between a blocking position for blocking rearward movement of a trigger housed in the trigger guard, and an unblocked position allowing rearward movement of the trigger in the trigger guard, wherein the trigger blocking device includes a blocking portion movable along the removable guard portion and an extension portion extending from the guard portion and into a grip, wherein the removable guard portion receives the blocking portion and the trigger blocking device is normally biased forwardly toward the blocking position to maintain contact between the blocking portion and the trigger as the trigger moves forwardly from an uncocked position of a hammer to a cocked position of the hammer, wherein the removable guard portion includes a notch that receives the blocking portion and the removable guard portion includes a pair of ears on opposite sides of the notch, wherein the pin extends between the ears through the elongated slot.

19. The apparatus of claim 18, wherein the blocking portion defines an elongated slot, and further comprising a pin that extends through the elongated slot to slidably capture the trigger blocking device on the removable guard portion.

* * * * *